US011703779B2

(12) United States Patent
Hongo et al.

(10) Patent No.: US 11,703,779 B2
(45) Date of Patent: Jul. 18, 2023

(54) FIXING DEVICE AND IMAGE-FORMING APPARATUS

(71) Applicant: FUJIFILM Business Innovation Corp., Tokyo (JP)

(72) Inventors: Mitsutoshi Hongo, Ebina (JP); Norio Ogawahara, Ebina (JP); Hideki Kuge, Ebina (JP); Kouichi Kimura, Ebina (JP); Takayuki Yamashita, Ebina (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 49 days.

(21) Appl. No.: 17/527,752

(22) Filed: Nov. 16, 2021

(65) Prior Publication Data

US 2022/0075297 A1 Mar. 10, 2022

Related U.S. Application Data

(63) Continuation of application No. PCT/JP2019/050792, filed on Dec. 25, 2019.

(30) Foreign Application Priority Data

Jun. 21, 2019 (JP) ..... 2019-115460

(51) Int. Cl.
*G03G 15/20* (2006.01)

(52) U.S. Cl.
CPC ..... *G03G 15/2007* (2013.01); *G03G 15/201* (2013.01); *G03G 15/2017* (2013.01); *G03G 15/2032* (2013.01); *G03G 2215/2003* (2013.01)

(58) Field of Classification Search
CPC ..... G03G 15/2007; G03G 15/201; G03G 15/2017; G03G 15/2032; G03G 2215/2003
See application file for complete search history.

(56) References Cited

U.S. PATENT DOCUMENTS 9,389,550 B2 * 7/2016 Saito ..... G03G 15/2017
2005/0042004 A1 * 2/2005 Segerer ..... G03G 15/2007 430/124.3
2008/0019745 A1 1/2008 Iwaishi et al.
(Continued)

FOREIGN PATENT DOCUMENTS

JP S57-190560 U 12/1982
JP S59-129885 A 7/1984
JP S62-264083 A 11/1987
(Continued)

OTHER PUBLICATIONS

Mar. 17, 2020 Search Report issued in International Patent Application No. PCT/JP2019/050792.
(Continued)

*Primary Examiner* — Joseph S Wong
(74) *Attorney, Agent, or Firm* — Oliff PLC

(57) ABSTRACT

A fixing device includes: a heating unit configured to heat a medium to be conveyed along a conveyance path by radiation; and a shielding unit made of non-metallic material, the shielding unit being configured to form a shielding state in which radiation from the heating unit is shielded and a non-shielding state in which radiation from the heating unit is not shielded, in which the shielding unit being expanded in a direction intersecting the radiation in the shielding state and is stored in the non-shielding state.

20 Claims, 3 Drawing Sheets

(56) References Cited

U.S. PATENT DOCUMENTS

2014/0270872 A1* 9/2014 Tamaki ..... G03G 15/2017
399/329

FOREIGN PATENT DOCUMENTS

| | | | |
|---|---|---|---|
| JP | 2006-091187 | A | 4/2006 |
| JP | 2009-288491 | A | 12/2009 |
| JP | 5217634 | B2 | 6/2013 |

OTHER PUBLICATIONS

Mar. 17, 2020 Written Opinion issued in International Patent Application No. PCT/JP2019/050792.

* cited by examiner

FIXING DEVICE AND IMAGE-FORMING APPARATUS

CROSS REFERENCE TO RELATED APPLICATIONS

This is a continuation of International Application No. PCT/JP2019/050792 filed on Dec. 25, 2019, and claims priority from Japanese Patent Application No. 2019-115460 filed on Jun. 21, 2019.

BACKGROUND

Technical Field

The present invention relates to a fixing device and an image forming apparatus.

Related Art

Patent Literature 1 describes an image forming apparatus. In the image forming apparatus, a shielding region in which radiation from a heating source to a heating region is shielded by a shielding portion is changed in accordance with a position of a sheet to be conveyed in the heating region.

CITATION LIST

Patent Literature

Patent Literature 1: JP-A-2009-288491

SUMMARY

One aspect of non-limiting embodiments of the present disclosure relates to saving space as compared with a case where a shielding unit that shields a heating unit is configured with a metallic member that does not deform, such as a stainless steel plate. Another aspect of non-limiting embodiments of the present disclosure relates to providing a fixing device and an image forming apparatus by which a heat insulating effect may be enhanced as compared with a case where a metallic member is formed thin enough to be wound up.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing device including:

a heating unit configured to heat a medium to be conveyed along a conveyance path by radiation; and a shielding unit made of non-metallic material, the shielding unit being configured to form a shielding state in which radiation from the heating unit is shielded and a non-shielding state in which radiation from the heating unit is not shielded, wherein the shielding unit is expanded in a direction intersecting the radiation in the shielding state and is stored in the non-shielding state.

BRIEF DESCRIPTION OF THE DRAWINGS

Exemplary embodiment(s) of the present invention will be described in detail based on the following figures, wherein.

DETAILED DESCRIPTION

First Exemplary Embodiment

Figure 1:
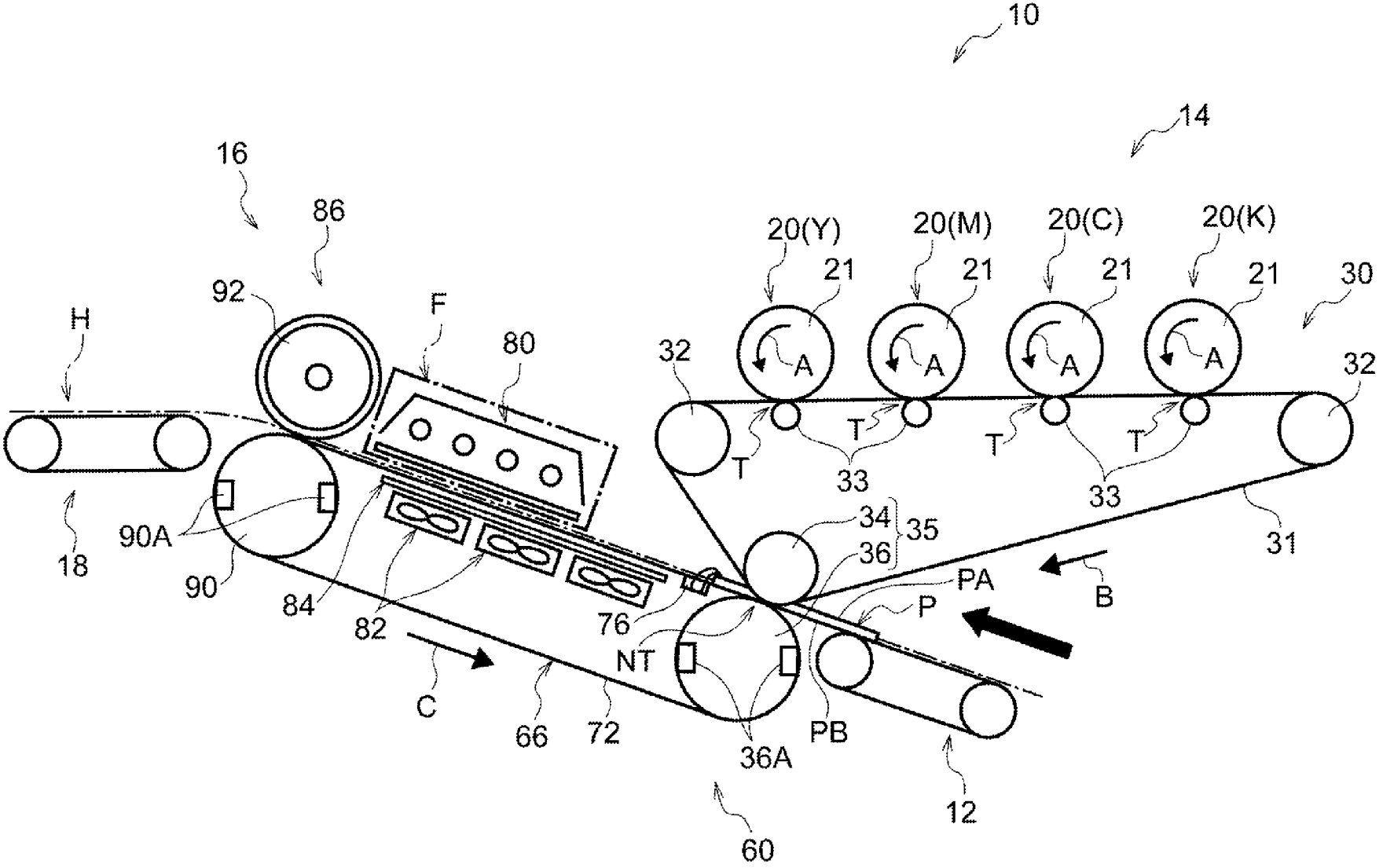
FIG. 1 is a schematic diagram showing a relevant part of an image forming apparatus according to a first exemplary embodiment.

Hereinafter, a first exemplary embodiment of the present invention will be described with reference to the drawings. FIG. 1 is a schematic diagram showing an image forming apparatus 10 according to the present exemplary embodiment. The image forming apparatus 10 is an apparatus that forms an image on a medium P such as a sheet.

The image forming apparatus 10 includes a forming unit 14 that forms a toner image on a medium P sent from an accommodating unit (not shown) via a feeding-conveyance unit 12, and a fixing device 16 that fixes the toner image formed on the medium P by the forming unit 14. The medium P to which the toner image is fixed is discharged from a discharge unit (not shown) via a discharging-conveyance unit 18.

(Forming Unit)

The forming unit 14 has a function of forming a toner image on the medium P. The forming unit 14 includes a toner image forming unit 20 that forms a toner image, and a transfer device 30 that transfers the toner image formed by the toner image forming unit 20 to the medium P.

[Toner Image Forming Unit]

The toner image forming unit 20 forms a toner image for each color, and includes toner image forming units 20(Y), 20(M), 20(C), and 20(K) of a total of four colors of yellow (Y), magenta (M), cyan (C), and black (K). The toner image forming units 20 of each color is basically configured in the same manner except for the toner to be used.

Figure 2:
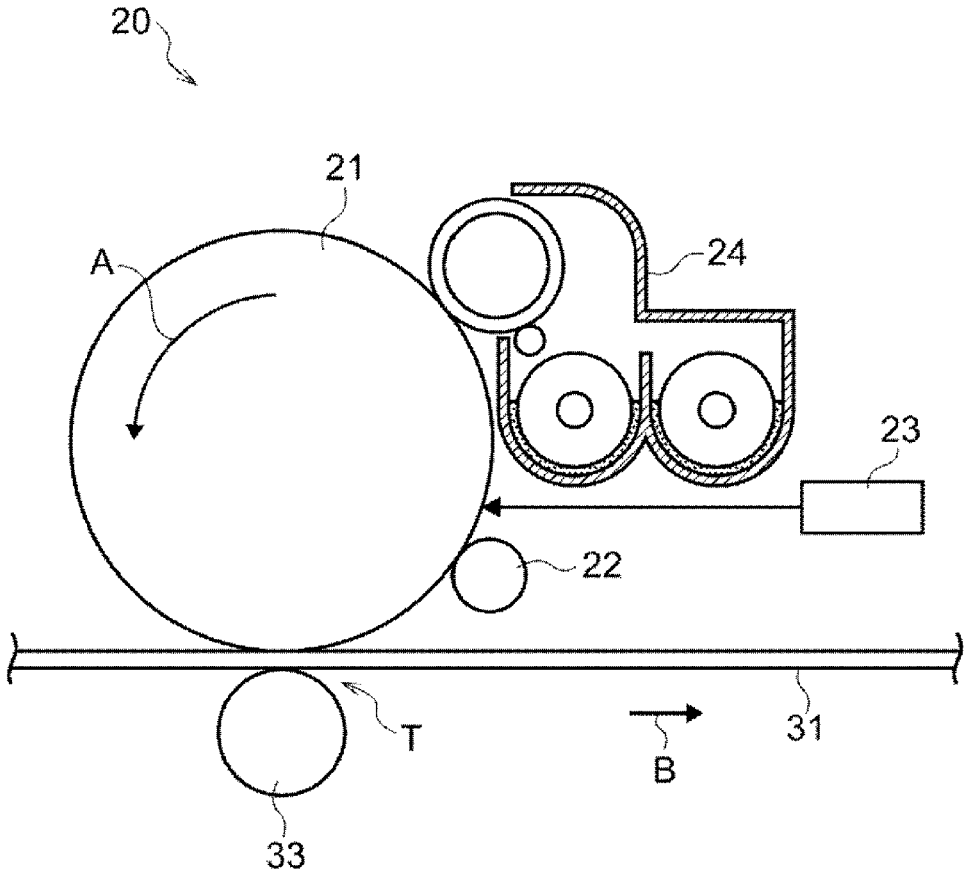
FIG. 2 is a schematic diagram showing a toner image forming unit of the image forming apparatus according to the first exemplary embodiment.

As shown in FIG. 2, the toner image forming unit 20 of each color includes a photoconductor drum 21 that rotates in an arrow A direction, and a charging device 22 that charges the photoconductor drum 21. The toner image forming unit 20 of each color includes an exposure device 23 that exposes the photoconductor drum 21 charged by the charging device 22 to form an electrostatic latent image on the photoconductor drum 21. The toner image forming unit 20 of each color further includes a developing device 24 that develops the electrostatic latent image formed on the photoconductor drum 21 by the exposure device 23 to form a toner image.

[Transfer Device]

As shown in FIG. 1, the transfer device 30 has a function of primarily transferring toner images of the photoconductor drums 21 of the respective colors onto an intermediate transfer body in a superimposed manner, and secondarily transferring the superimposed toner images onto the medium P. The transfer device 30 includes a transfer belt 31 as an intermediate transfer body, a primary transfer roller 33, and a transfer unit 35.

The primary transfer roller 33 has a function of transferring the toner image formed on the photoconductor drum 21 to the transfer belt 31 at a primary transfer position T between the photoconductor drum 21 and the primary transfer roller 33. The transfer belt 31 has an endless shape and is wound around plural rollers 32.

The transfer belt 31 has a function of conveying the primarily transferred toner image to a secondary transfer position NT by rotating in an arrow B direction when at least one of the rollers 32 is driven to rotate.

The transfer unit 35 has a function of transferring the toner image transferred to the transfer belt 31 to the medium P. The transfer unit 35 includes a secondary transfer unit 34 and a counter roller 36 that are disposed to face each other. The transfer belt 31 is disposed between the secondary transfer unit 34 and the counter roller 36. A recessed portion 36A, which may accommodate a gripper 76 to be described later, is formed on an outer peripheral surface of the counter roller 36.

The transfer unit 35 transfers the toner image transferred to the transfer belt 31 to the medium P passing through the secondary transfer position NT by an electrostatic force generated by the discharging of the secondary transfer unit 34.

(Conveyance Mechanism)

A conveyance mechanism 60 is disposed between the feeding-conveyance unit 12 and the discharging-conveyance unit 18. The conveyance mechanism 60 has a function of receiving the medium P from the feeding-conveyance unit 12 by a chain gripper 66. The conveyance mechanism 60 has a function of delivering the received medium P to the discharging-conveyance unit 18 via the secondary transfer position NT, the heating unit 80, and a fixing unit 86.

The chain gripper 66 includes a pair of endless chains 72 that are separated from each other in a direction perpendicular to a paper surface of FIG. 1, and a gripper 76 that is provided between the two chains 72. The gripper 76 holds a distal end portion of the medium P on a downstream side in a medium conveying direction. Each of the chains 72 is wound around a sprocket (not shown) provided at both ends of the counter roller 36 and a sprocket (not shown) provided at both ends of a pressurizing roller 90 described later.

The chain gripper 66 rotates in an arrow C direction when either one of the two sprockets is rotated, and conveys the medium P held by the gripper 76 through the secondary transfer position NT, the heating unit 80, the fixing unit 86, and the discharging-conveyance unit 18 in this order.

(Fixing Device)

The fixing device 16 has a function of fixing the toner image formed on the medium P by the forming unit 14. The fixing device 16 includes the heating unit 80 disposed on a downstream side of the secondary transfer position NT, the chain gripper 66 described above, a blower 82, a ventilation plate 84, and the fixing unit 86.

Figure 3:
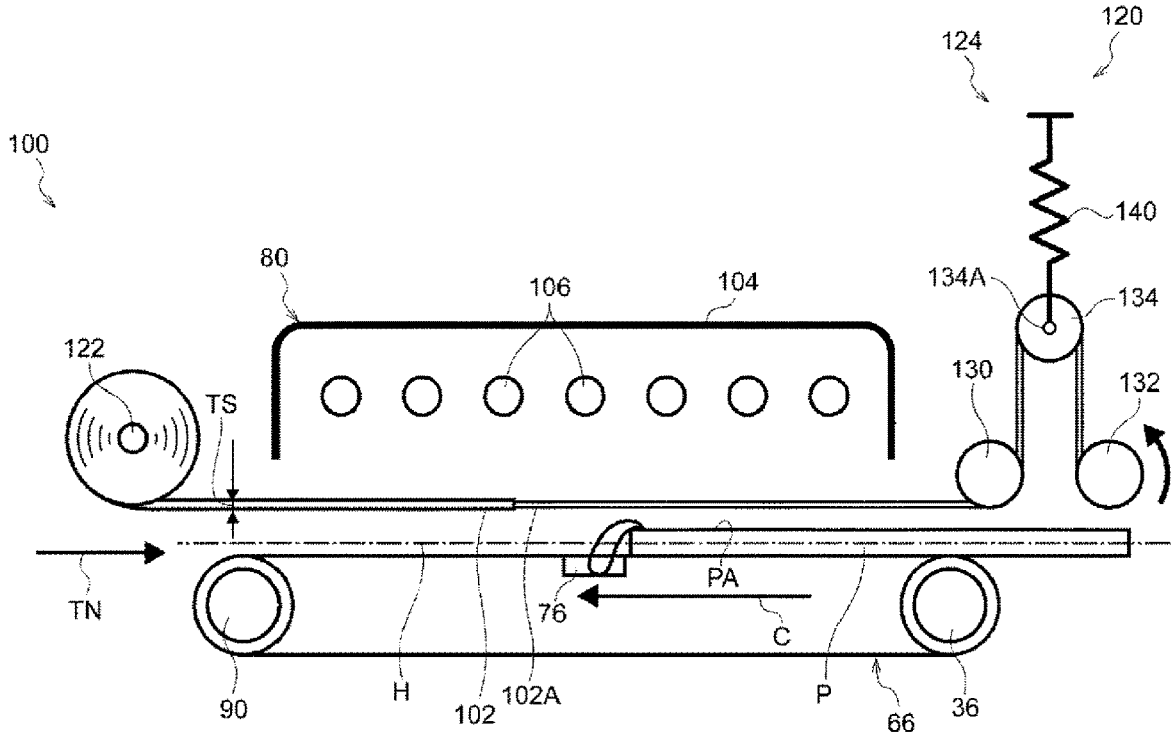
FIG. 3 is an enlarged view showing an F portion in FIG. 1.

As shown in FIG. 3, the fixing device 16 includes a restricting mechanism 100 that restricts the release of radiation heat from the heating unit 80, and the restricting mechanism 100 includes a shielding unit 102 that shields the heating unit 80.

[Heating Unit]

The heating unit 80 has a function of melting the toner image on the medium P by heating a surface PA of the medium P conveyed along a conveyance path H by the chain gripper 66 by radiation transmission in a non-contact manner. The heating unit 80 includes a reflection plate 104 and heating sources 106.

[Reflection Plate]

The reflection plate 104 is formed in a container shape that is open toward a lower side of the apparatus, and has a function of reflecting infrared rays from the heating source 106 toward the lower side of the apparatus. The reflection plate 104 is formed using a metal plate such as an aluminum plate.

[Heating Source]

The heating source 106 includes, for example, plural heaters. The heaters of the heating source 106 may be, for example, a cylindrical infrared heater.

[Chain Gripper]

The chain gripper 66 conveys the medium P while causing the surface PA of the medium P to face the heating source 106 of the heating unit 80 when the chain rotates in the arrow C direction in a state in which the gripper 76 holds a front end portion of the medium P.

[Blower]

As illustrated in FIG. 1, the blowers 82 are disposed on an inner side of the chain gripper 66 and on a lower side of the heating unit 80. The blower 82 blows air to a back surface PB of the medium P conveyed by the chain gripper 66, and causes the medium P to float.

[Ventilation Plate]

The ventilation plate 84 is disposed between the blower 82 and the heating unit 80 and on an inner peripheral side of the chain gripper 66. The ventilation plate 84 includes plural ventilation holes through which the air from the blower 82 passes toward the back surface PB of the medium P conveyed by the chain gripper 66.

Accordingly, the medium P conveyed by the chain gripper 66 is caused to float, and the back surface PB of the medium P is brought into a non-contact state relative to the ventilation plate 84.

[Fixing Unit]

The fixing unit 86 includes a heating roller 92 and the pressurizing roller 90. The fixing unit 86 has a function of fixing the toner image to the medium P by being brought into contact with the medium P to perform heating and pressurization.

[Heating Roller]

The heating roller 92 includes a built-in heating source, comes into contact with the surface PA of the medium P conveyed by the chain gripper 66 to heat the medium P, and fixes the toner image to the medium P.

[Pressurizing Roller]

The pressure roller 90 has a function of pressurizing the medium P by sandwiching the medium P between the pressurizing roller 90 and the heating roller 92. A recessed portion 90A that may accommodate the gripper 76 is formed in an outer peripheral surface of the pressurizing roller 90.

[Restricting Mechanism]

As illustrated in FIG. 3, the restricting mechanism 100 includes the shielding unit 102 that shields radiation from the heating unit 80 to a heating region, and a drive unit 120 that drives the shielding unit 102.

[Drive Unit]

The drive unit 120 includes a storage roller 122 provided on a downstream side of the heating unit 80 in a medium conveying direction, and a tension applying unit 124 provided on an upstream side of the heating unit 80 in the medium conveying direction. The tension applying unit 124 applies tension to the shielding unit 102 in the shielding state, which will be described later.

The storage roller 122 is given a rotational force in a direction in which the shielding unit 102 is wound up by a spring (spiral spring), for example. The storage roller 122 has a function of storing the shielding unit 102 by winding the shielding unit 102. As a result, space saving of the storage space is achieved.

The tension applying unit 124 includes a guiding roller 130, a winding roller 132, and a tension roller 134 provided between the guiding roller 130 and the winding roller 132.

The guiding roller 130 guides the shielding unit 102 pulled out from the storage roller 122 and a wire 102A extending from a distal end of the shielding unit 102 along the conveyance path H between the heating unit 80 and the conveyance path H. The winding roller 132 is rotationally driven by a rotation mechanism such as a motor (not shown), and has a function of winding up the wire 102A and the shielding unit 102 when being rotated in a winding direction.

When the winding roller 132 rotates in the winding direction to wind up the wire 102A and the shielding unit 102, the shielding unit 102 is pulled out from the storage roller 122 in an expanding direction TN, and the shielding unit 102 is expanded between the heating unit 80 and the conveyance path H. Here, the expanding direction TN is a direction intersecting the radiation from the heating unit 80. Then, the shielding unit 102 is maintained in an expanded state by a self-lock function of the rotation mechanism such as the motor. As a result, a shielding state in which the release of the radiation heat from the heating device 80 is prevented by the shielding unit 102 is formed, and the propagation of the heat from the heating unit 80 to the counter members such as the chain gripper 66, the blower 82, and the ventilation plate 84 is prevented.

In addition, for example, an electromagnetic clutch that connects the rotation mechanism and the winding roller 132 is turned off to make the winding roller 132 rotatable, thereby allowing the shielding unit 102 to be wound around the storage roller 122 to which a rotational force is applied in the winding direction. As a result, the shielding unit 102 expanded between the heating unit 80 and the conveyance path H is deformed and wound up and stored on the winding roller 132.

A rotation shaft 134A of the tension roller 134 is supported by a housing via a coil spring 140. In other words, the tension roller 134 is pulled upward by the coil spring 140. In other words, the tension roller 134 is pulled in a direction away from the guiding roller 130. As a result, the tension roller 134 applies tension to the shielding unit 102 in the expanding direction TN.

[Shielding Unit]

The shielding unit 102 forms a shielding state in which radiation from the heating unit 80 to the heating region is shielded and a non-shielding state in which the radiation from the heating unit 80 to the heating region is not shielded. The shielding unit 102 is expanded between the heating unit 80 and the conveyance path H in the shielding state, and shields the heating unit 80 to prevent the release of the radiation heat from the heating unit 80. In the non-shielding state, the shielding unit 102 is retracted from between the heating unit 80 and the conveyance path H, deformed, and stored.

The shielding unit 102 is configured with a non-metallic member. A heat-resistant temperature of the non-metallic member is 350° C. or higher. A heat-resistant temperature of the shielding unit 102 may be set to 500° C. or higher. The heat-resistant temperature may be rephrased as a continuous use temperature. The continuous use temperature (test) is a standard of long-term physical property evaluation (heat resistance) of a substance defined in UL 746B of the UL standard. The continuous use temperature refers to an upper limit temperature at which, when a substance is left in the air at the continuous use temperature for 40000 hours, a physical property value such as the strength of the substance is maintained at 50% or more of an initial value.

In addition, the shielding unit 102 is preferably a member having a thickness dimension TS shown in FIG. 3 of 1 mm or more and 5 mm or less. When the thickness dimension TS is more than 5 mm, storability in the case where the shielding unit is deformed and stored, specifically, a winding property in the case where the shielding unit is wound and stored may be deteriorated.

Here, the metal excluded from the materials of the shielding unit 102 refers to a metal generally used as a shield, such as stainless steel (SUS) or aluminum.

As the non-metallic member constituting the shielding unit 102, a cloth of glass fibers, a sheet material, or the like is used, and it is possible to deform and store the shielding unit while ensuring the heat insulating property.

Specific examples of the member constituting the shielding unit 102 include a glass wool sheet (paper) made of glass fibers, and a rock wool sheet made of basalt or andesite as a raw material. Specific examples of the member constituting the shielding unit 102 include a silica cloth made of silicon dioxide and a ceramic fiber sheet containing alumina ($Al_2O_3$) and silica ($SiO_2$) as a major component.

Here, the heat-resistant temperature (continuous use temperature) of the glass wool sheet is 350° C., and the heat-resistant temperature (continuous use temperature) of the rock wool sheet is 400° C. The heat-resistant temperature (continuous use temperature) of the silica cloth is 600° C., and the heat-resistant temperature (continuous use temperature) of the ceramic fiber sheet is 1000° C.

Examples of the shielding unit 102 formed of fibers include a sheet body in which plural fibers are plain-woven, and the sheet body may be rephrased as a woven fabric. In addition, examples of the shielding unit 102 formed of fibers include a nonwoven fabric which is a sheet body in which fibers are entangled without being woven.

Figure 4:
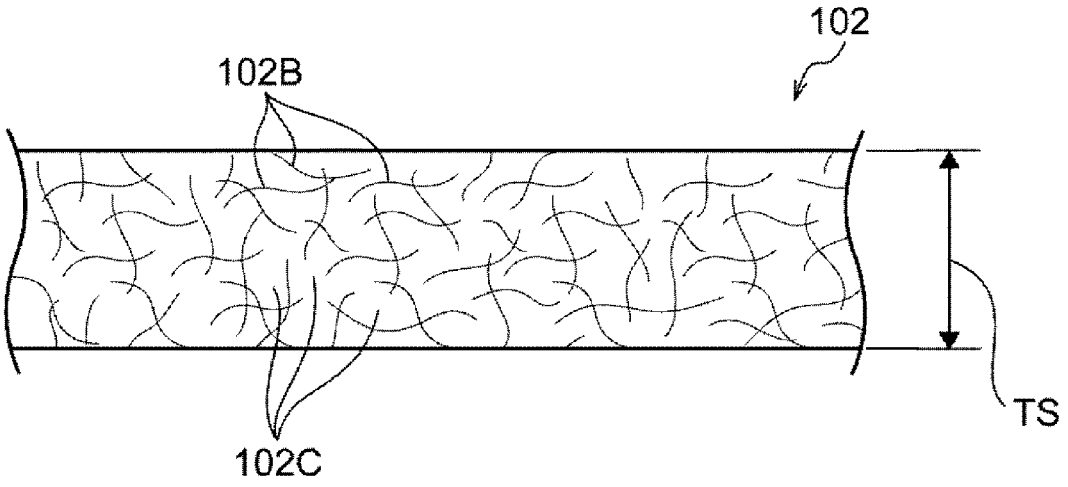
FIG. 4 is a schematic diagram showing an example of a shielding unit according to the first exemplary embodiment.

FIG. 4 is a diagram showing an example of the shielding unit 102, and shows a sheet body that is made of a nonwoven fabric formed of plural fibers 102B. Spaces 102C are provided between the fibers 102B, and plural voids are formed inside the shielding unit 102 by the spaces 102C.

(Actions and Effects)

The actions of the present exemplary embodiment according to the above configuration will be described.

The shielding unit 102 is configured with a non-metallic member that may be expanded in a shielding state in which the heating unit 80 is shielded, and may be deformed and stored in a non-shielding state in which the heating unit 80 is not shielded.

Therefore, the space may be saved as compared with the case where the shielding unit 102 that shields the heating unit 80 is configured with a metallic member that does not deform, and the heat insulating effect may be enhanced as compared with the case where the metallic member is formed thin enough to be wound up.

That is, if only to enhance the heat insulating effect, the thickness of a common metal member such as stainless steel and aluminum may be increased. However, when the thickness of the metallic member is increased, deformation becomes difficult, and the storability deteriorates. On the other hand, when the metallic member is made thin in order to increase the flexibility, the heat insulating effect is reduced.

In contrast, in the present exemplary embodiment, the shielding unit 102 is configured with a non-metallic member, so that it is possible to improve flexibility while ensuring a good heat insulating property, and to form a storage state in which the heating unit is deformed.

In addition, the shielding unit 102 includes a member having a thickness dimension TS of 1 mm or more, so that the heat insulation property may be enhanced as compared with a case where a shielding unit 102 includes a part having a thickness dimension TS of less than 1 mm.

Furthermore, the shielding unit 102 has voids inside, so that the heat insulating property may be enhanced as compared with a case where a solid shielding unit 102 is used.

In addition, the shielding unit 102 is configured with a sheet body formed of plural fibers 102B, and the void is configured with spaces 102C between the fibers 102B. Therefore, as compared with a case where a void is formed inside the solid shielding unit 102, the void is easily formed inside the shielding unit 102.

Furthermore, the tension applying unit 124 that applies tension to the shielding unit 102 in the shielding state is provided, so that the looseness of the shielding unit 102 may be prevented as compared with a case where tension is not applied to the shielding unit 102 in the shielding state.

As a result, it is possible to prevent unexpected contact between the medium P on the conveyance path H and the shielding unit 102.

Second Exemplary Embodiment

Figure 5:
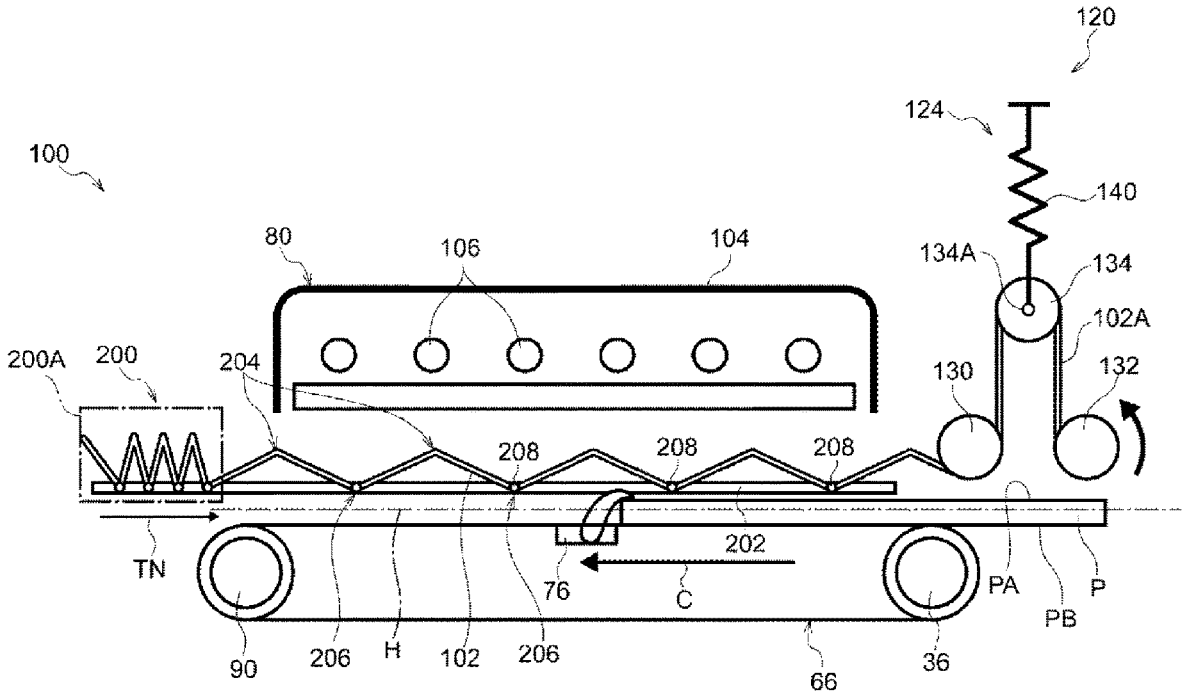
FIG. 5 is a schematic diagram showing a relevant part of a fixing device according to a second exemplary embodiment, and corresponds to the F portion in FIG. 1.

FIG. 5 is a diagram showing a second exemplary embodiment, in which the same or equivalent parts as those of the first exemplary embodiment are denoted by the same reference numerals, description thereof is omitted, and different parts will be described. The second exemplary embodiment is different from the first exemplary embodiment in the shielding unit 102 used in the fixing device 16 and the support structure of the shielding unit 102.

[Drive Unit]

That is, the drive unit 120 includes a storage unit 200 provided on the downstream side of the heating unit 80 in the medium conveying direction, the tension applying unit 124 provided on the upstream side of the heating unit 80 in the medium conveyance direction, and a pair of rails 202 that guide the shielding unit 102. The rails 202 extend along the medium conveying direction. The tension applying unit 124 applies tension to the folded shielding unit 102 in the expanding direction TN.

[Shielding Unit]

The shielding unit 102 is configured with a non-metallic member having a heat-resistant temperature of 500° C. or higher. A base end portion of the shielding unit 102 in the length direction is fixed to a wall surface 200A of the storage unit 200, and the wire 102A extends from a distal end of the shielding unit 102 in the length direction.

In the shielding unit 102, mountain fold portions 204 and valley fold portions 206 are alternately formed in a length direction, and guide bars 208 extend from both side portions of the valley fold portion 206. A distal end portion of the guide bar 208 is movably supported by the corresponding rail 202, and the valley fold portions 206 of the shielding unit 102 moves along the rails 202.

When the winding roller 132 is rotated in the winding direction and the wire 102A extending from the shielding unit 102 and the shielding unit 102 are wound, the shielding unit 102 is pulled out from the storage unit 200 in the expanding direction TN. Then, the shielding unit 102 is expanded between the heating unit 80 and the conveyance path H. As a result, a shielding state in which the release of the radiation heat from the heating unit 80 is prevented by the shielding unit 102 is formed.

Further, when the winding roller 132 is rotated in a reverse direction, a force for causing the shielding unit to return to the folded state acts on the shielding unit 102. Then, the shielding unit 102 disposed between the heating unit 80 and the conveyance path H is deformed and folded, and is stored in the storage unit 200. As a result, a non-shielding state in which the release of the radiation heat from the heating unit 80 is allowed is formed.

(Actions and Effects)

In the present exemplary embodiment, the same actions and effects as those of the first exemplary embodiment may be obtained for the same or similar configuration portions as those of the first exemplary embodiment.

The tension applying unit 124 applies tension in the expanding direction TN to the shielding unit 102 folded at the mountain fold portions 204 and the valley fold portions 206, so that the shielding unit 102 is extended at the mountain fold portions 204 and the valley fold portions 206. Therefore, compared with a case where the shielding unit 102 in a state in which the shielding unit 102 is not stretched at all from a state in which the shielding unit 102 is folded at the mountain fold portions 204 and the valley fold portions 206 is heated by the heating unit 80 in a shielding state, a range within which the shielding unit 102 is heated is reduced.

The shielding unit 102 may be stored by deformation other than winding or folding. The expanding direction TN of the shielding unit 102 is not limited to the medium conveying direction as long as the expanding direction TN is a direction intersecting the radiation from the heating unit 80, and may be, for example, a direction intersecting the medium conveying direction.

The shielding unit 102 is not limited to a single-layer structure. The shielding unit 102 may have a configuration in which plural layers are stacked. Further, the shielding unit 102 may be a structure having no void therein.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a heating unit configured to heat a medium to be conveyed along a conveyance path by radiation; and a shielding unit made of non-metallic material, the shielding unit being configured to form a shielding state in which radiation from the heating unit is shielded and a non-shielding state in which radiation from the heating unit is not shielded, wherein the shielding unit is expanded in a direction intersecting the radiation in the shielding state and is stored in the non-shielding state.

2. The fixing device according to claim 1, wherein the shielding unit includes a member having a thickness dimension of 1 mm or more.

3. The fixing device according to claim 1, wherein the shielding unit has a void therein.

4. The fixing device according to claim 2, wherein the shielding unit has a void therein.

5. The fixing device according to claim 3, wherein the shielding unit is configured with a sheet body formed of a plurality of fibers, and the void is configured with spaces between the fibers.

6. The fixing device according to claim 4, wherein the shielding unit is configured with a sheet body formed of a plurality of fibers, and the void is configured with spaces between the fibers.

7. The fixing device according to claim 1, further comprising a tension applying unit configured to apply tension to the shielding unit in the shielding state.

8. The fixing device according to claim 2, further comprising a tension applying unit configured to apply tension to the shielding unit in the shielding state.

9. The fixing device according to claim 3, further comprising a tension applying unit configured to apply tension to the shielding unit in the shielding state.

10. The fixing device according to claim 4, further comprising a tension applying unit configured to apply tension to the shielding unit in the shielding state.

11. The fixing device according to claim 5, further comprising a tension applying unit configured to apply tension to the shielding unit in the shielding state.

12. The fixing device according to claim 6, further comprising a tension applying unit configured to apply tension to the shielding unit in the shielding state.

13. The fixing device according to claim 7, wherein the shielding unit is folded and stored in the non-shielding state, and the tension applying unit applies the tension in a direction in which the folded shielding unit is expanded.

14. The fixing device according to claim 8, wherein the shielding unit is folded and stored in the non-shielding state, and the tension applying unit applies the tension in a direction in which the folded shielding unit is expanded.

15. The fixing device according to claim 9, wherein the shielding unit is folded and stored in the non-shielding state, and the tension applying unit applies the tension in a direction in which the folded shielding unit is expanded.

16. The fixing device according to claim 10, wherein the shielding unit is folded and stored in the non-shielding state, and the tension applying unit applies the tension in a direction in which the folded shielding unit is expanded.

17. The fixing device according to claim 7, further comprising:

a storage unit configured to store the shielding unit; and a wire extending from a distal end of the shielding unit, wherein the tension applying unit further includes a winding roller configured to wind the wire to cause the shielding unit to shift from the non-shielding state to the shielding state.

18. The fixing device according to claim 17, wherein the tension applying unit further comprises a tension roller that applies tension to the shielding unit by pulling the wire in a direction different from a winding direction of the winding roller.

19. An image forming apparatus comprising:

a forming unit configured to form a toner image on a medium;

a conveyance mechanism configured to convey the medium on which the toner image is formed along the conveyance path; and the fixing device according to claim 1 that is configured to fix the toner image formed on the medium by the forming unit, wherein the shielding unit is expanded between the heating unit and the conveyance mechanism in the shielding state.

20. The image forming apparatus according to claim 19, further comprising a rail that extends in a conveying direction of the medium between the heating unit and the conveyance mechanism and guides movement of the shielding unit.

* * * * *